US007661445B2

(12) United States Patent
Miller

(10) Patent No.: US 7,661,445 B2
(45) Date of Patent: Feb. 16, 2010

(54) SHIELDED CATHODE ASSEMBLY

(75) Inventor: Robert Steven Miller, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 11/305,962

(22) Filed: Dec. 19, 2005

(65) Prior Publication Data

US 2007/0140431 A1 Jun. 21, 2007

(51) Int. Cl.
*H01J 35/06* (2006.01)

(52) U.S. Cl. ..... 138/136; 378/203

(58) Field of Classification Search ..... 378/119, 378/136, 142

See application file for complete search history.

(56) References Cited

U.S. PATENT DOCUMENTS 3,885,179 A * 5/1975 Friedel ..... 378/136
3,946,261 A 3/1976 Holland et al.
4,359,642 A * 11/1982 Heinz et al. ..... 378/150
4,360,735 A 11/1982 Seifert
4,631,744 A 12/1986 Haberrecker
4,819,260 A 4/1989 Haberrecker
5,065,420 A 11/1991 Levene
5,526,396 A 6/1996 Jacob
6,400,799 B1 * 6/2002 Andrews ..... 378/141
6,438,207 B1 8/2002 Chidester et al.
6,487,273 B1 11/2002 Takenaka et al.
6,556,654 B1 4/2003 Hansen et al.
6,560,315 B1 5/2003 Price et al.
6,666,811 B1 12/2003 Good
6,728,335 B1 4/2004 Thompson et al.
6,738,552 B2 5/2004 Hirsch
6,749,337 B1 * 6/2004 Artig et al. ..... 378/203
6,819,741 B2 11/2004 Chidester
6,888,922 B2 5/2005 Schaefer et al.
2004/0202282 A1 * 10/2004 Miller ..... 378/140
2005/0232396 A1 * 10/2005 Chidester ..... 378/136
2006/0177001 A1 * 8/2006 Lovoi et al. ..... 378/136

* cited by examiner

*Primary Examiner*—Hoon Song
(74) *Attorney, Agent, or Firm*—Workman Nydegger

(57) ABSTRACT

This disclosure concerns cathode assemblies. In one example, a shielded cathode assembly for use in an x-ray tube includes an electron source and a cathode head within which the electron source is at least partially disposed. The cathode head is made from an x-ray shielding material.

22 Claims, 3 Drawing Sheets

SHIELDED CATHODE ASSEMBLY

BACKGROUND OF THE INVENTION

1. The Field of the Invention

The present invention relates generally to x-ray tubes. More particularly, exemplary embodiments of the invention concern a shielded cathode assembly configured and arranged to control the unintended emission of x-rays from certain regions of an x-ray tube.

2. Related Technology

X-ray tubes are extremely valuable tools that are used in a wide variety of applications, both industrial and medical. An x-ray tube typically includes a cathode assembly and an anode assembly disposed within an evacuated enclosure. The cathode assembly includes an electron source and the anode assembly includes a target surface that is oriented to receive electrons emitted by the electron source. During operation of the x-ray tube, an electric current is applied to the electron source, which causes electrons to be produced by thermionic emission. The electrons are then accelerated toward the target surface of the anode assembly by applying a high voltage potential between the cathode assembly and the anode assembly. When the electrons strike the anode assembly target surface, the kinetic energy of the electrons causes the production of x-rays. The x-rays ultimately exit the x-ray tube through a window in the x-ray tube, and interact with a material sample, patient, or other object.

Stationary anode x-ray tubes employ a stationary anode assembly that maintains the anode target surface stationary with respect to the stream of electrons produced by the cathode assembly electron source. In contrast, rotary anode x-ray tubes employ a rotary anode assembly that rotates portions of the anode's target surface into and out of the stream of electrons produced by the cathode assembly electron source. The target surfaces of both stationary and rotary anode x-ray tubes are generally angled, or otherwise oriented, so as to maximize the amount of x-rays produced at the target surface that can exit the x-ray tube via a window assembly.

Notwithstanding the orientation of both stationary and rotary anode target surfaces, x-rays nonetheless emanate in various directions from the target surface. Thus, while some x-rays do exit through the x-ray tube windows and are utilized as intended, some x-rays do not exit through the x-ray tube windows. X-rays that do not pass through the x-ray tube windows often penetrate instead into other areas of the x-ray tube, where the x-rays may, undesirably, be transmitted through other x-ray tube surfaces if sufficient measures to prevent the escape of those x-rays are not taken.

The escape of unusable x-rays from an x-ray tube is undesired as such x-rays can represent a significant source of x-ray contamination to x-ray tube surroundings. For instance, such unused x-rays can result in transmission of a relatively high level of radiation to x-ray tube operators.

In addition, unused x-rays can interfere with the imaging x-ray stream that is transmitted through the window. Such interference may compromise the quality of the images obtained with the x-ray device. For example, unused x-rays can impinge upon areas of the x-ray subject and interfere with the image being sought. The resulting interference may be manifested as clouding in the image.

While the problem can be realized throughout the tube environment, certain areas of the x-ray tube are especially susceptible to the impingement of non-window transmitted x-rays. For example, the area of the x-ray tube immediately behind the cathode assembly can be especially problematic. Since the electron source of the cathode assembly faces the target surface of the anode assembly, errant x-rays can emanate from the target surface toward the cathode assembly. Cathode assembly components are typically made of metals that are not effective at shielding x-rays, such as nickel or copper. X-rays typically pass through the cathode assembly without being absorbed, thus necessitating shielding materials behind the cathode assembly, either inside the x-ray tube or external to the x-ray tube.

Efforts to reduce the effects of unused x-rays have centered around the use of external shielding on x-ray tube structures. For instance, in many stationary anode x-ray tubes, a lining of lead shielding is placed about the inner surface of an outer housing, containing the x-ray tube, in order to absorb unused x-rays that are produced at the target surface and penetrate the evacuated enclosure of the x-ray tube.

The use of this type of shielding can be problematic however. For example, while such shielding can be effective at absorbing x-rays, lead is relatively heavy and substantially adds to the weight of the x-ray tube. This factor becomes important in applications where a relatively low x-ray tube weight is desired or even required.

Another problem relates to the tendency of x-rays to spread out somewhat as the x-rays travel further away from the target surface. In particular, because the lead lining is often placed relatively far away from the target surface of the anode, such as when the lining is attached to the outer housing located beyond the outer surface of the evacuated enclosure, relatively large amounts of lead must be used to cover significant portions of the enclosure surface in order to account for the spreading of the x-rays. In some cases, nearly the entire surface area of the evacuated enclosure must be covered by a lead lining to prevent x-ray emission from the x-ray tube. The addition of lead linings represents a significant cost in time and labor during x-ray tube manufacture.

In sum, there is an unmet need in the field of x-ray tubes to provide an x-ray tube structure that reduces the emission of errant x-rays, and that does so in a manner that minimizes the use of excessive, heavy internal or external shielding that significantly adds to the weight of the x-ray tube. Moreover, techniques for minimizing x-ray emissions in the region of the cathode assembly would be especially attractive.

SUMMARY OF EXAMPLE EMBODIMENTS OF THE INVENTION

Example embodiments of the invention are concerned with providing a shielded cathode assembly for use in an x-ray tube. Among other things, example embodiments of the shielded cathode assembly are configured and arranged to reduce, if not eliminate, the need for supplemental x-ray shielding behind the shielded cathode assembly.

In one exemplary embodiment of the present invention, a shielded cathode assembly for use in an x-ray tube includes an electron source and a cathode head within which the electron source is at least partially disposed. At least a portion of the cathode head of the shielded cathode assembly is made from, or otherwise incorporates, an x-ray shielding material.

In another exemplary embodiment of the present invention, an x-ray tube includes an anode assembly and a shielded cathode assembly. The shielded cathode assembly includes an electron source and a cathode head within which the electron source is at least partially disposed. At least a portion of the cathode head is likewise made from, or otherwise incorporates, an x-ray shielding material.

In yet another exemplary embodiment of the present invention, an x-ray tube includes an evacuated enclosure with at least two ends, an anode assembly disposed in a first end of the evacuated enclosure, and a shielded cathode assembly disposed in a second end of the evacuated enclosure. The shielded cathode assembly includes an electron source and a means for shielding x-rays. The means for shielding x-rays substantially shields the second end of the evacuated enclosure from x-rays emanating from the anode assembly.

These and other aspects of exemplary embodiments of the invention will become more fully apparent from the following description and appended claims.

BRIEF DESCRIPTION OF THE DRAWINGS

In order that the manner in which the above recited and other advantages and objects of the invention are obtained, a more particular description of the invention briefly described above will be given by making reference to specific embodiments that are illustrated in the appended drawings. These drawings depict only exemplary embodiments of the invention and are not to be considered limiting of its scope.

DETAILED DESCRIPTION OF EXEMPLARY EMBODIMENTS OF THE INVENTION

Reference will now be made to the drawings to describe exemplary embodiments of the invention. It is to be understood that the drawings are diagrammatic and schematic representations of these embodiments, and are not limiting of the invention, nor are they necessarily drawn to scale.

In general, embodiments of the invention are concerned with a shielded cathode assembly for use in an x-ray tube. In some exemplary embodiments of the invention, the components of the shielded cathode assembly comprise an x-ray shielding material, such as tungsten, that is appropriate for use in the high temperature vacuum environment of an x-ray tube. Moreover, the shielded cathode assembly is positioned relatively close to the target surface of the x-ray tube anode assembly in order to intercept and absorb some of the unused x-rays. As a result of this arrangement, the shielded cathode assembly is able to reduce the amount of radiation shielding that is needed further away from the target surface, such as at points internal to or external to the evacuated enclosure.

I. Exemplary Operating Environment for a Shielded Cathode Assembly

Figure 1:
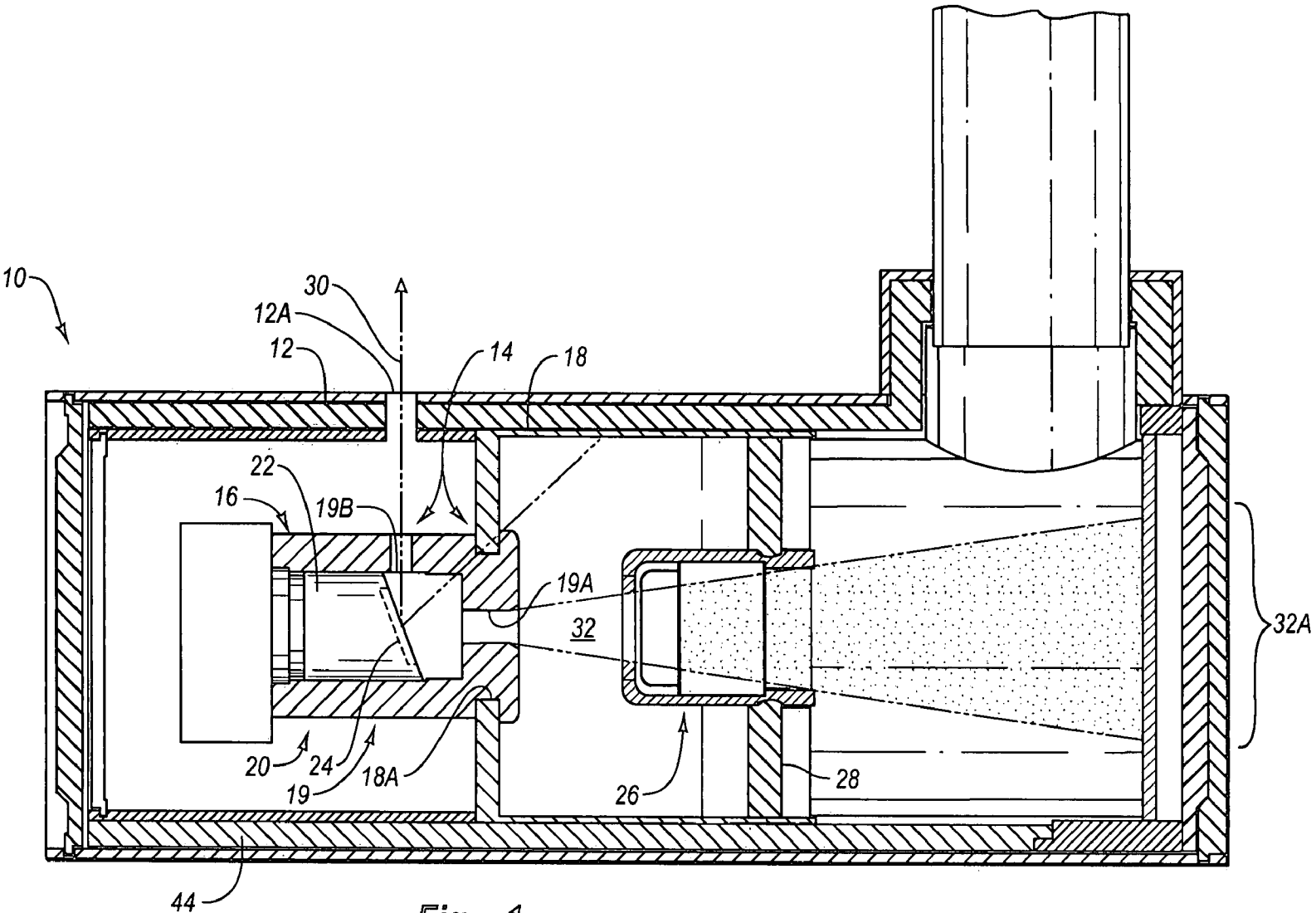
FIG. 1 illustrates a simplified, partial cross sectional view of a stationary anode x-ray tube in accordance with one embodiment of the shielded cathode assembly of the invention.

Reference is first made to FIG. 1, which depicts an exemplary x-ray tube 10. In the exemplary illustrated embodiment, the x-ray tube 10 is a stationary anode type with a grounded anode, but the scope of the invention is not so limited. Rather, embodiments of the invention are concerned with a variety of different types of x-ray tubes including diagnostic and therapeutic devices, as well as with devices for use in areas such as materials analysis and structural analysis, for example. Moreover, such devices may comprise stationary or rotary anode type devices. As well, other embodiments of the invention are concerned with anode grounded, cathode grounded, or double ended x-ray tubes.

The exemplary x-ray tube 10 includes an outer housing 12 within which various components of x-ray tube 10 are contained. As discussed below, the outer housing 12 includes a window 12A thorough which x-rays pass. An evacuated enclosure 14, disposed within outer housing 12, is collectively defined by an anode assembly 16 and a can 18 that are attached to each other. In the illustrated embodiment, the anode assembly 16 is received in an opening 18A defined at one end of the can 18. The portion of the x-ray tube 10 where the anode assembly 16 is located may be referred to generally herein as the anode end of the x-ray tube. The anode assembly 16 and can 18 are hermetically joined together in order to be maintain a vacuum in the evacuated enclosure 14.

Anode assembly 16 includes a housing 19 that houses a stationary anode 20 that includes a substrate 22 upon which is disposed a target surface 24. Target surface 24 of stationary anode 20 comprises a material suitable for producing x-rays when impinged upon by electrons. Suitable materials for target surface 24 have high-Z numbers and include materials such as rhodium, palladium, and tungsten. As discussed in further detail below, an opening 19A defined in housing 19 is positioned so that electrons from a cathode can impact the target surface 24. The housing 19 additionally defines an opening 19B, aligned with window 12A, through which x-rays emanating from the target surface 24 pass.

As suggested above, a shielded cathode assembly, denoted generally at 26, is disposed within the can 18 and situated so as to emit electrons that form a beam oriented in the direction of the target surface 24. The shielded cathode assembly 26 is supported within the can 18 by a plate 28. In some embodiments, the plate 28 comprises, or otherwise implements, an x-ray shield. The portion of the x-ray tube 10 where the shielded cathode assembly 26 is located may be referred to generally herein as the cathode end of the x-ray tube.

In operation, an electrical current is supplied to the shielded cathode assembly 26 via a high voltage connector (not shown), which causes a beam of electrons to be emitted from the shielded cathode assembly 26. In addition, a high voltage differential is applied between the shielded cathode assembly 26 and the anode assembly 16 by biasing shielded cathode assembly 26 with a high voltage potential provided by a voltage source. At the same time, the target surface 24 of the anode assembly 16 is held at ground potential. As a result of this high potential difference between the shielded cathode assembly 26 and the anode assembly 16, electrons emitted by the shielded cathode assembly 26 to accelerate rapidly and pass through opening 19A. The electrons then impact the target surface 24 of the anode assembly 16, producing x-rays that emanate in various directions from the target surface 24. At least some of the x-rays, denoted generally at 30, pass through the window 12A defined in the outer housing 12. These x-rays can be used for a variety of applications, including x-ray imaging and diagnostics, therapeutic applications, and materials analysis.

Other x-rays, however, emanate in undesired directions and, accordingly, are of no practical use. Some of these unusable x-rays emanate into target surface 24 or anode substrate 22. These x-rays are absorbed and generally are not problematic insofar as x-ray device operators and other personnel and equipment in the surrounding area are concerned. As indicated in FIG. 1 however, yet other x-rays emanate from the target surface 24 in a generally conical x-ray pattern 32 that is at least partially intercepted by the shielded cathode assembly 26. Accordingly, the exemplary cathode head configurations disclosed herein comprise exemplary structural implementations of a means for shielding. However, any other structure (s) that implement functionality comparable to that of such exemplary cathode heads may also be employed.

As further indicated in FIG. 1, the placement and configuration of the shielded cathode assembly 26 substantially forecloses the need for shielding in the area 32A defined by the imaginary projection of the conical pattern 32. In at least some embodiments, this effect is achieved through the use of a shielded cathode assembly 26 and/or its components, that are substantially circular in shape. However, other shielded cathode assembly 26 geometries may be employed as well.

II. Construction and Operation of an Exemplary Shielded Cathode Assembly

Figure 2:
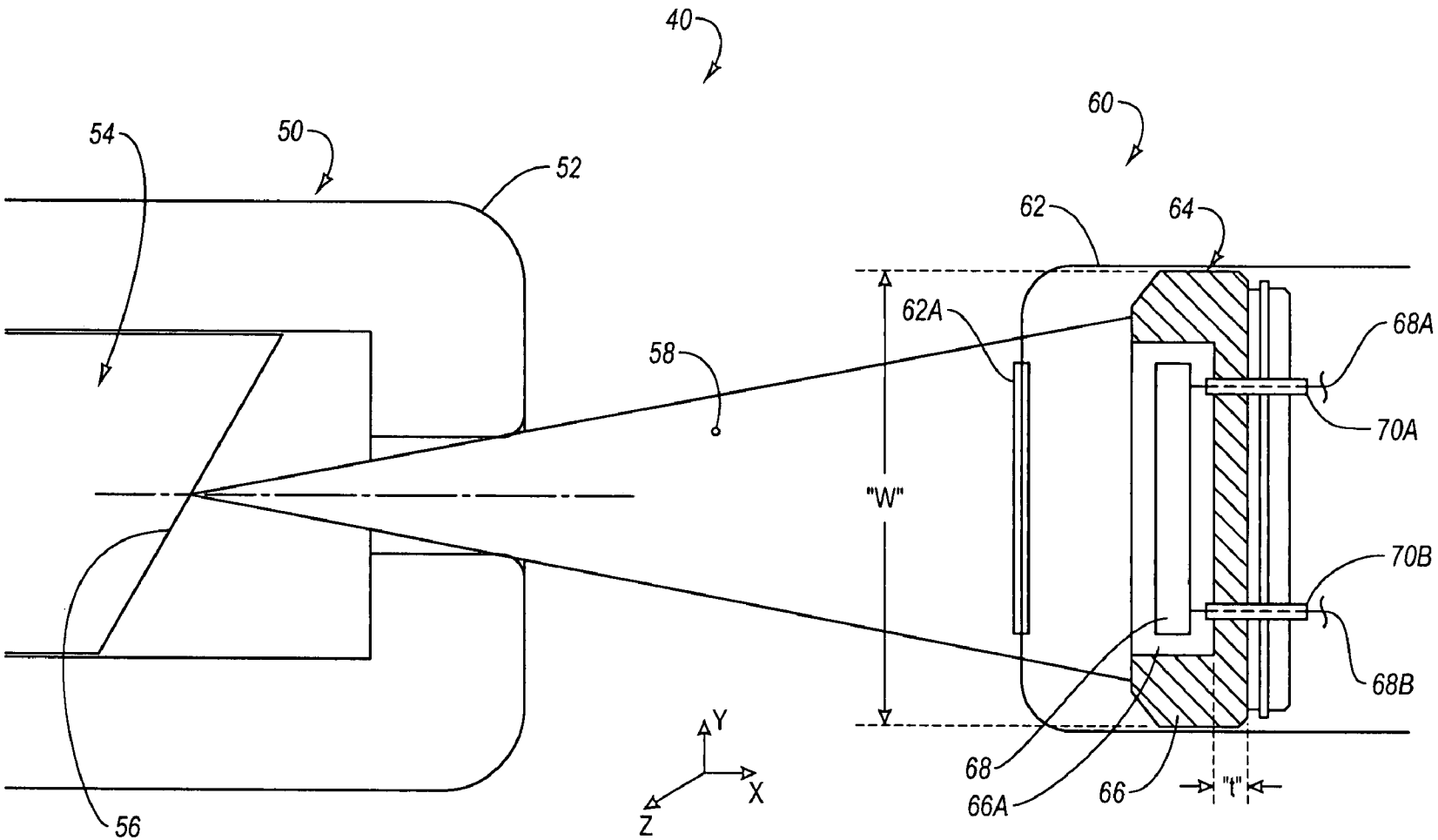
FIG. 2 illustrates a simplified, partial cross sectional view of a stationary anode x-ray tube in accordance with one embodiment of the shielded cathode assembly of the invention.

With attention now to FIG. 2, details are provided concerning an exemplary embodiment of an x-ray device 40 that includes a stationary anode assembly 50 and a shielded cathode assembly 60, with particular attention being directed to a discussion of the shielded cathode assembly 60.

The stationary anode assembly 50 generally includes a housing 52 within which a stationary anode 54 is positioned. The stationary anode 54 includes a target surface 56 arranged to receive an electron beam from the shielded cathode assembly 60. As a result of the arrangement of the stationary anode assembly 50 and the shielded cathode assembly 60 relative to each other, some of the x-rays generated at the target surface 56 are, undesirably, directed back toward the shielded cathode assembly 60, as exemplified by the x-ray pattern 58 illustrated in FIG. 2.

With respect to the shielded cathode assembly 60, it was noted elsewhere herein that in order to intercept and absorb the stream of x-rays indicated by the pattern 58, the shielded cathode assembly 60 is generally sized and positioned to substantially intercept those x-rays. In general, such functionality is accomplished by constructing at least some portions of the shielded cathode assembly 60 of an x-ray shielding material.

Generally, such x-ray shielding material refers to any material, or materials, that are substantially non-transparent to x-rays, or that otherwise attenuate x-rays to an acceptable level. As contemplated herein, attenuation of x-rays refers to the notion that while some x-rays may not be completely blocked by the shielding material, the shielding material affects individual and/or collective characteristics of those x-rays in such a way that the attenuated x-rays meet a predetermined standard of acceptability. Such standards may be defined, for example, by the user, the manufacturer, industry standards bodies, and/or governmental agencies.

Examples of attenuation include, but are not limited to, a relative reduction in the total number of x-rays permitted to pass a certain location, a relative reduction in the total number of x-rays permitted to pass through a unit area, a relative reduction in the total number of x-rays permitted to pass a certain location and/or through a unit area for a given period of time. Further examples of attenuation include a relative reduction in the power of the x-rays.

Exemplary x-ray shielding materials, also referred to herein simply as shielding materials, possess various characteristics. For example, shielding materials typically possesses a high-Z number so that those materials can effectively absorb, or at least attenuate, x-rays. Second, exemplary shielding materials also possess adequate thermal stability, so that the material can be subjected to high temperatures for sustained periods of time without material degradation. Also, exemplary shielding materials are sufficiently pure in the their desired composition as to avoid the presence of unwanted potential contaminants that could compromise the vacuum of the evacuated enclosure through outgassing or other phenomena.

Consistent with the foregoing, some exemplary embodiments of the shielded cathode assembly 60 include one or more components substantially comprising tungsten, though alternative materials may be employed. Examples of suitable alternative materials include, but are not limited to, high-Z number materials such as molybdenum, tantalum, rhenium, rhodium, palladium, gold, platinum, niobium, and zirconium.

With particular attention now to the shielded cathode assembly 60 disclosed in FIG. 2, a housing 62 is provided within which a cathode head 64 is disposed. The housing 62 defines an opening 62A through which electrons emitted by the cathode head 64 pass. Some or all of the housing 62 may comprise x-ray shielding material, where at least a portion of the x-ray shielding material of the housing 62 is configured and arranged to intercept part of the x-ray pattern 58. The housing 62 need not be employed in all cases however. Thus, in some exemplary embodiments, the housing 62 is omitted.

In the illustrated embodiment, the housing 62 encloses a cathode head 64 that includes a body 66 that defines a recess 66A within which a filament 68, or other electron source, is disposed. The filament 68 is connected with a pair of electrical leads 68A and 68B partially enclosed in sleeves 70A and 70B, respectively, that pass through the body 66. In at least some implementations, the sleeves 70A and 70B, and/or other components of the shielded cathode assembly 60, comprise x-ray shielding material.

As indicated in FIG. 2, the body 66 of the cathode head 64 is, in general, configured and arranged to intercept substantially all of the x-ray pattern 58. In one embodiment, the body of the cathode head 64 is implemented as a solid piece of shielding material, or materials, which blocks, or at least attenuates, substantially all of the x-rays that are incident upon the cathode head 64. In another embodiment, part or all of the body comprises a material that is only partially effective in blocking x-rays of the x-ray pattern 58, and separate x-ray shielding is attached to the body in order to enable more complete blocking of the x-ray pattern 58.

Of course, the illustrated configuration of the cathode head 64 is exemplary only and the geometry, orientation, arrangement, and construction materials of the cathode head 64 may be varied to suit a particular application. As an example, the cathode head 64 may be substantially circular in some embodiments, but may be elliptical, polygonal, or have some other shape, in other embodiments.

As another example, geometric aspects such as the thickness "t" and maximum outer dimension "w" of the cathode head 64 must be sufficient to substantially prevent the passage of x-rays incident upon the cathode head 64. Further, the thickness "t" of the thinnest portion of the cathode head 64 that is in the x-ray path will depend upon considerations such as the anticipated energy of the x-rays that will be incident upon the cathode head 64, as well as the type of material(s) that will be employed in the construction of the cathode head 64. The "t," "w" and other dimensions of the cathode head 64 can also vary based on any number of factors, including, for example, the x-ray tube operating voltage, the proximity of the cathode head 64 to the target surface 56, and the physical dimensions of the x-ray device 40.

At least some of the design considerations relating to the cathode head 64 are interrelated. For example, a relatively dense material, such as tungsten for example, permits construction of a relatively thin cathode head to be used in absorbing x-rays of a given energy. On the other hand, a relatively less dense material, such as molybdenum for example, must be employed in greater thicknesses to absorb x-rays of the same energy.

Additionally, the cathode head 64 of the shielded cathode assembly 60 can be manufactured using any one of a variety of methods. In one exemplary embodiment, cathode head 64 is machined from a mass of suitable material. In other embodiments, hot isostatic press ("HIP") and sintering methods can be employed to produce a cathode head having a composite shielding material composition.

For instance, using the HIP method, a cathode head can be manufactured by first filling an appropriately sized mold with a tungsten and copper powder mixture. The powder-filled mold is then placed in an oven where the tungsten/copper mixture is subjected to high temperature and pressure for a specified amount of time. The high pressure and heat environment of the oven solidifies the powder composition, increasing the powder composition density while also reducing the porosity of the powder composition. Once the HIP process is complete, the cathode head is removed from the mold and final finishing steps, if needed, are performed to complete production of the cathode head. A cathode head produced by the HIP method above yields a component having a tungsten-copper matrix composition that contains the desired shielding characteristics sufficient for use in absorbing x-rays.

As noted above, sintering can also be used in manufacturing the cathode head 64. In one exemplary sintering process, tungsten, nickel, and iron powders of various proportions are mixed together and then subjected to solid and/or liquid phase sintering to form a mass of matrix material. The matrix material can then be formed or shaped as needed to produce the cathode head. As in the case of the HIP method, an exemplary cathode head produced by sintering comprises a tungsten-nickel-iron matrix composition that is configured to absorb x-rays incident upon it. Further details concerning the HIP and sintering methods above as applied to the manufacture of x-ray tube components can be found in U.S. Pat. No. 6,749,337, entitled "X-Ray Tube and Method of Manufacture," which is incorporated herein by reference in its entirety.

With continuing attention to FIG. 2, and referring as well to FIG. 1, details are now provided concerning certain operational aspects of the exemplary shielded cathode assembly 60. In particular, the x-ray pattern 58 of unused x-rays emanates from the stationary anode assembly 50 toward the shielded cathode assembly 60. As the x-ray pattern 58 generally diverges, in this instance, with increasing distance from the stationary anode assembly 50, placement of the shielded cathode assembly 60 relatively closer to the stationary anode assembly will afford the use of a relatively smaller shielded cathode assembly. Correspondingly, placement of the shielded cathode assembly 60 relatively further away from the stationary anode assembly will generally require the use of a relatively larger shielded cathode assembly so as to ensure achievement of a desired level of interception of the pattern 58.

As the x-rays of the x-ray pattern 58 reach the cathode head 64, those x-rays are at least partially intercepted and absorbed by the cathode head 64, so that further penetration of the x-rays into and/or through the x-ray tube device along the "x" axis is substantially prevented. Likewise, further penetration of the x-rays of x-ray pattern 58 into and/or through the x-ray device along axes "y" and "z" is also substantially prevented. Thus, the need for x-ray shielding on portions of the x-ray device located beyond the shielded cathode assembly 60 is substantially obviated. In one arrangement, exemplified in FIG. 1, the need for shielding in the area denoted 32A is eliminated, or at least substantially reduced, as a result of the configuration and placement of the shielded cathode assembly and, more particularly, the configuration and placement of the cathode head 64. By reducing, if not eliminating, the need for supplemental x-ray shielding, embodiments of the invention contribute to a significant reduction in x-ray tube weight.

II. Exemplary Shielded Cathode Assembly in a Rotary Anode X-Ray Tube

It was noted earlier herein that embodiments of the invention are concerned with a variety of different types and configurations of x-ray devices. Directing attention now to FIG. 3, details are provided concerning an exemplary x-ray tube 110 that includes a rotary anode, discussed below. The x-ray tube 110 includes an outer housing 112 which includes a window 113 and defines an evacuated enclosure 114 within which the main components of x-ray tube 110 are contained. Disposed within evacuated enclosure 114 is a rotary anode assembly 116, including an anode disk 118 with a target track 120 disposed on one surface of anode disk 118.

Similar to target surface 24 of FIG. 1, target track 120 comprises a material suitable for producing x-rays when impinged by electrons. Target track 120 is also partially oriented toward a shielded cathode assembly 122 which includes a cathode head 124 and one or more electron sources, in this case a filament 126. The configuration and position of shielded cathode assembly 122 in relation to target track 120 enables electrons produced at filament 126 to travel toward focal track 120 during x-ray tube operation.

In general, the discussion of other exemplary cathode heads disclosed herein is germane as well to cathode head 124. Thus, the cathode head 124 may be implemented as a solid piece of shielding material or may otherwise be constructed to include shielding structures and materials. As well, the geometry, orientation, arrangement, and construction materials of the cathode head 124 may be varied to meet requirements.

Finally, the exemplary x-ray tube 110 may include a shield structure 128 positioned between the shielded cathode assembly 122 and the rotary anode assembly 116 such that electrons from the shielded cathode assembly 122 pass through the shield structure 128 to the target track 120 of the rotary anode assembly 116.

Figure 3:
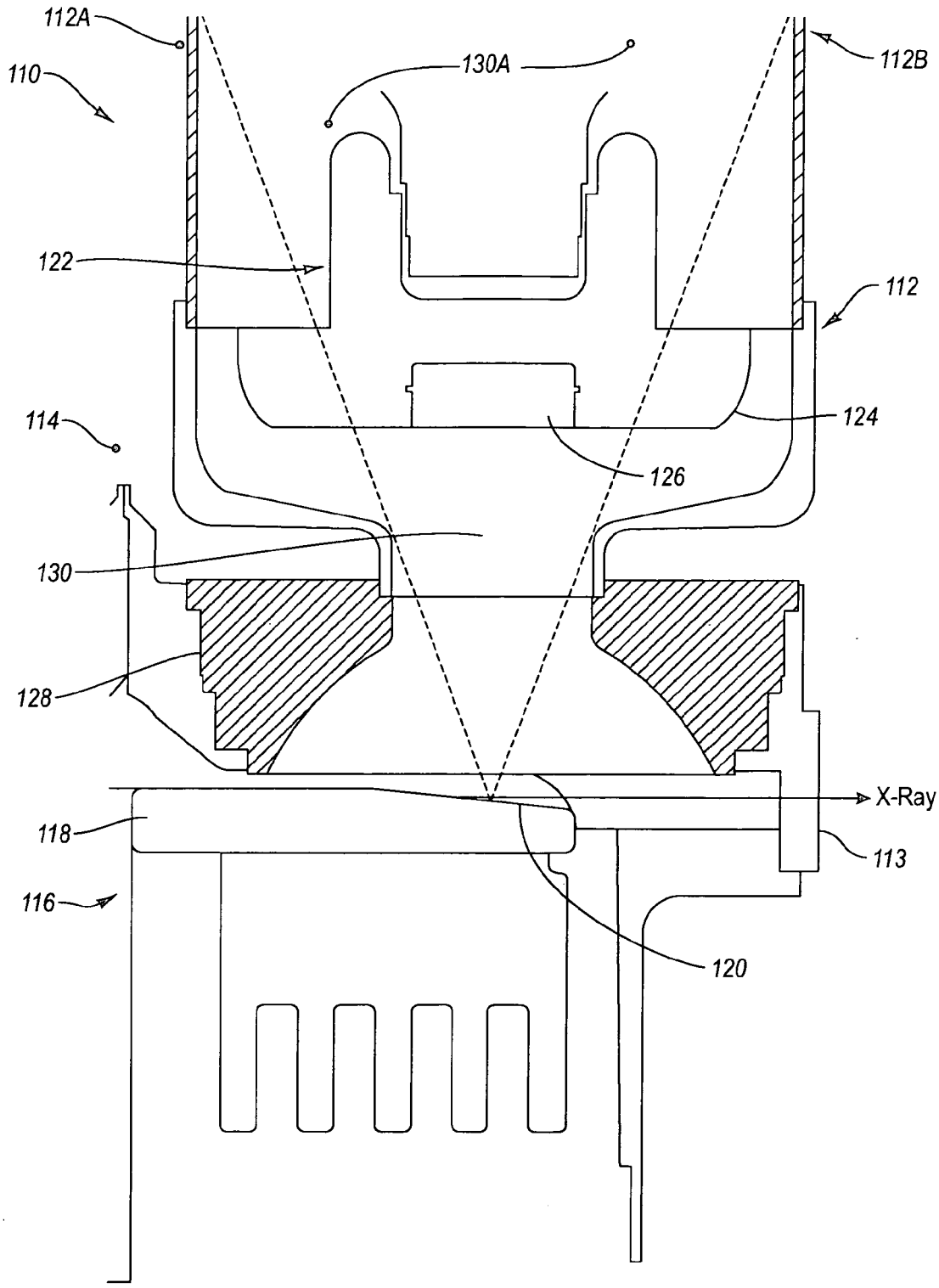
FIG. 3 illustrates a simplified, partial cross sectional view of a rotary anode x-ray tube in accordance with one embodiment of the shielded cathode assembly of the invention.

The operation of x-ray tube 110 of FIG. 3 differs from the operation of x-ray tube 10 of FIG. 1 in that anode disk 118 rotates during x-ray tube operation, so that the beam of electrons produced at filament 126 strike varying positions around target track 120. As the electrons impact the target track 120, the kinetic energy of some of the electrons causes the production of x-rays. The impingement of electrons produced at filament 126 onto target track 120 causes a plurality of x-rays to be continually produced at target track 120 during operation of x-ray tube 110. These x-rays emanate in various directions from target track 120.

A portion of the x-rays pass through the window 113. The beam of x-rays exiting window 130 can be used for a variety of applications, including x-ray imaging and materials analysis. The remainder of x-rays, however, emanate in directions other than through the window 113 and, as such, are of no practical use. At least some of such unusable x-rays are emanated in an x-ray pattern 128 which is generally conical in some cases, but may take other forms as well.

Similar to the case of the exemplary cathode heads disclosed in FIGS. 1 and 2, the cathode head 124 is configured and arranged to substantially intercept the x-ray pattern 128. As a result of this arrangement, the shielding material of the cathode head 124 is able to block, or at least attenuate, a substantial portion of the x-rays in the x-ray pattern 128. Thus, the need for supplemental shielding in areas 112A and 112B, for example, of the x-ray tube 110 is reduced, if not eliminated. This is graphically indicated by way of the imaginary projection 130A of the x-ray pattern 128. Among other things, elimination of the need for supplemental shielding reduces the overall weight of the x-ray tube 110 and simplifies the manufacturing of the x-ray tube 110.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A shielded cathode assembly for use in an x-ray tube, the cathode assembly comprising:

an electron source; and a cathode head upon which the electron source is mounted, the cathode head comprised entirely of one or more x-ray shielding materials, one of the x-ray shielding materials having an atomic number that is greater than or equal to 45 such that all x-rays that are incident upon any portion of the cathode head are attenuated.

2. The shielded cathode assembly as recited in claim 1, wherein one of the x-ray shielding materials comprises tungsten.

3. The shielded cathode assembly as recited in claim 1, wherein one of the x-ray shielding materials comprises a tungsten-copper matrix.

4. The shielded cathode assembly as recited in claim 1, wherein one of the x-ray shielding materials comprises a tungsten-nickel-iron matrix.

5. The shielded cathode assembly as recited in claim 1, wherein one of the x-ray shielding materials comprises a material having an atomic number that is greater than or equal to 74.

6. The shielded cathode assembly as recited in claim 1, further comprising a housing within which the cathode head is substantially disposed, the housing including an x-ray shielding portion and an x-ray transmissive portion, the x-ray transmissive portion substantially aligned with the electron source.

7. The shielded cathode assembly as recited in claim 1, wherein the cathode head is formed as an integral piece.

8. The shielded cathode assembly as recited in claim 1, wherein the cathode head is implemented as a solid piece of x-ray shielding material.

9. The shielded cathode assembly as recited in claim 1, wherein the one or more x-ray shielding materials comprise one or more of tantalum, rhenium, rhodium, palladium, gold, platinum, niobium, and zirconium.

10. The shielded cathode assembly as recited in claim 1, wherein at thickness 't' and/or width 'w' of the cathode head are determined based on one or more of an x-ray tube operating voltage, proximity of the cathode head to a target surface, and physical dimensions of an x-ray device with which the shielded cathode assembly is associated.

11. An x-ray tube comprising:

an anode assembly; and a shielded cathode assembly arranged to transmit electrons to the anode assembly, the shielded cathode assembly comprising:

an electron source; and a cathode head within which the electron source is at least partially disposed, the cathode head being implemented as a solid piece comprised entirely of one or more x-ray shielding materials, at least one of the x-ray shielding materials having an atomic number that is greater than or equal to 45, such that all x-rays that are incident upon any portion of the cathode head are substantially attenuated.

12. The x-ray tube as recited in claim 11, wherein one of the x-ray shielding materials comprises tungsten.

13. The x-ray tube as recited in claim 11, wherein one of the x-ray shielding materials comprises a tungsten-copper matrix.

14. The x-ray tube as recited in claim 11, wherein one of the x-ray shielding materials comprises a tungsten-nickel-iron matrix.

15. The x-ray tube as recited in claim 11, wherein the anode assembly comprises a stationary anode.

16. The x-ray tube as recited in claim 11, further comprising a housing within which the cathode head is substantially disposed, the housing including an x-ray transmissive portion and an x-ray shielding portion, the x-ray transmissive portion positioned along a line defined by a point on a target surface of the anode assembly and a point on the cathode head.

17. The x-ray tube as recited in claim 11, wherein the cathode head is formed as an integral piece.

18. The x-ray tube as recited in claim 11, wherein the anode assembly comprises a rotary anode.

19. An x-ray tube comprising:

an anode assembly comprising a target surface;

a shielded cathode assembly positioned to direct electrons to the target surface of the anode assembly, the shielded cathode assembly comprising an electron source and a cathode head upon which the electron source is mounted, the cathode head being implemented as a solid piece comprised entirely of one or more x-ray shielding materials such that all x-rays that are incident upon any portion of the cathode head are substantially attenuated;

an evacuated enclosure within which the anode assembly and shielded cathode assembly are positioned; and an outer housing within which the evacuated enclosure is positioned, the outer housing comprising a shielded portion that is substantially non-transmissive to x-rays, the housing further comprising an unshielded portion that is substantially transmissive to x-rays, the unshielded portion intersected by a line defined by a point on the target surface of the anode assembly and a point on the cathode head.

20. The x-ray tube as recited in claim 19, wherein at least one of the x-ray shielding materials has an atomic number that is greater than or equal to 45.

21. The x-ray tube as recited in claim 20, wherein the at least one x-ray shielding material comprises tungsten.

22. The x-ray tube as recited in claim 19, wherein the shielded portion of the outer housing comprises lead shielding.

* * * * *

UNITED STATES PATENT AND TRADEMARK OFFICE

CERTIFICATE OF CORRECTION

PATENT NO. : 7,661,445 B2
APPLICATION NO. : 11/305962
DATED : February 16, 2010
INVENTOR(S) : Miller It is certified that error appears in the above-identified patent and that said Letters Patent is hereby corrected as shown below:

Column 4
Line 4, change "thorough" to --through--
Line 47, delete "to"

Column 8
Line 7, change "II." to --III.--
Line 29, change "focal" to --target--
Line 56, change "130" to --113--
Line 61, change "128" to --130--
Line 65, change "128" to --130--

Column 9
Line 1, change "128" to --130--
Line 5, change "128" to --130--

Signed and Sealed this

Sixth Day of July, 2010

David J. Kappos

David J. Kappos
*Director of the United States Patent and Trademark Office*